US010283913B2

(12) United States Patent
Takeuchi

(10) Patent No.: US 10,283,913 B2
(45) Date of Patent: May 7, 2019

(54) ELECTRICAL CONNECTOR WITH A SHIELDING PLATE

(71) Applicant: Hirose Electric Co., Ltd., Tokyo (JP)

(72) Inventor: Yosuke Takeuchi, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 10 days.

(21) Appl. No.: 15/645,925

(22) Filed: Jul. 10, 2017

(65) Prior Publication Data

US 2018/0013240 A1 Jan. 11, 2018

(30) Foreign Application Priority Data

Jul. 11, 2016 (JP) ..... 2016-136789

(51) Int. Cl.
*H01R 13/652* (2006.01)
*H01R 13/6471* (2011.01)
(Continued)

(52) U.S. Cl.
CPC ..... *H01R 13/652* (2013.01); *H01R 13/05* (2013.01); *H01R 13/6471* (2013.01);
(Continued)

(58) Field of Classification Search
CPC .. H01R 12/73; H01R 12/716; H01R 13/6587; H01R 12/91; H01R 13/518; H01R 13/6471; H01R 12/7082; H01R 12/712; H01R 13/516; H01R 13/6586; H01R 12/707; H01R 13/6461; H01R 13/6473; H01R 13/6582; H01R 13/6594; H01R 12/585; H01R 12/592; H01R 12/727; H01R 13/05; H01R 13/26; H01R 13/41; H01R 13/6467; H01R 13/652; H01R 13/65802;
(Continued)

(56) References Cited

U.S. PATENT DOCUMENTS 6,638,079 B1 * 10/2003 Billman ..... H01R 13/514 439/76.1
6,648,657 B1 * 11/2003 Korsunsky ..... H01R 13/6594 439/108
(Continued)

*Primary Examiner* — Amy Cohen Johnson
*Assistant Examiner* — Matthew T Dzierzynski
(74) *Attorney, Agent, or Firm* — Procopio, Cory, Hargreaves & Savitch LLP

(57) ABSTRACT

An electrical connector with a shielding plate in which signal terminals and ground terminals supported by insulating members are arranged in an intermixed order, signal terminals have at least a portion in the longitudinal direction thereof covered by a shielding plate, and respective contact portions formed in free end portions at the front ends of the signal terminals and ground terminals are subject to contact pressure applied by the corresponding counterpart terminals to one side of said contact portions, thereby resulting in resilient flexure, wherein in the shielding plate, at positions corresponding to the ground terminals in the direction of terminal array, there are provided grounding strips parallel to said ground terminals, said grounding strips extend forward and, at least in a state of contact between the ground terminals and counterpart terminals, the other side of the ground terminals is in contact with and supported by the grounding strips.

8 Claims, 5 Drawing Sheets

(51) Int. Cl.

| | |
|---|---|
| ***H01R 13/6587*** | (2011.01) |
| ***H01R 13/05*** | (2006.01) |
| ***H01R 13/6594*** | (2011.01) |
| *H01R 12/70* | (2011.01) |
| *H01R 12/71* | (2011.01) |
| *H01R 12/73* | (2011.01) |

(52) U.S. Cl.
CPC ..... *H01R 13/6594* (2013.01); *H01R 12/7029* (2013.01); *H01R 12/716* (2013.01); *H01R 12/73* (2013.01)

(58) Field of Classification Search
CPC ... H01R 13/6585; H01R 23/688; H01R 24/60
See application file for complete search history.

(56) References Cited

U.S. PATENT DOCUMENTS

| | | | | |
|---|---|---|---|---|
| 6,672,886 | B2 * | 1/2004 | Billman | H01R 13/631 439/751 |
| 6,685,485 | B2 * | 2/2004 | Korsunsky | H05K 1/117 439/108 |
| 7,094,102 | B2 * | 8/2006 | Cohen | H05K 1/14 439/607.08 |
| 7,396,259 | B2 * | 7/2008 | Marshall | H01R 13/516 439/108 |
| 7,467,955 | B2 * | 12/2008 | Raistrick | H01R 13/26 439/75 |
| 7,976,316 | B2 * | 7/2011 | Ohshida | H01R 13/514 439/607.39 |
| 8,241,070 | B2 * | 8/2012 | Matsuzawa | H01R 13/514 439/701 |
| 8,647,151 | B2 * | 2/2014 | Ikegami | H01R 13/6587 439/607.07 |
| 8,764,464 | B2 | 7/2014 | Buck et al. | |
| 9,130,314 | B2 * | 9/2015 | Pao | H01R 13/6587 |
| 9,184,523 | B2 * | 11/2015 | Tamai | H01R 31/06 |
| 9,203,194 | B2 * | 12/2015 | Yu | H01R 13/6587 |
| 9,356,369 | B2 * | 5/2016 | Tamai | H01R 12/7082 |
| 9,478,889 | B2 * | 10/2016 | Oshida | H01R 13/42 |
| 9,478,924 | B2 * | 10/2016 | Tamai | H01R 24/60 |
| 9,705,273 | B2 * | 7/2017 | Guetig | H01R 43/16 |
| 2015/0038018 | A1 * | 2/2015 | Matsuzawa | H01R 12/716 439/638 |

* cited by examiner

ELECTRICAL CONNECTOR WITH A SHIELDING PLATE

CROSS REFERENCE TO RELATED APPLICATIONS

This Paris Convention Patent Application claims benefit under 35 U.S.C. § 119 and claims priority to Japanese Patent Application No. JP 2016-136789, filed on Jul. 11, 2016, titled "ELECTRICAL CONNECTOR WITH A SHIELDING PLATE", the content of which is incorporated herein in its entirety by reference for all purposes.

TECHNICAL FIELD

The present invention relates to an electrical connector with a shielding plate.

BACKGROUND ART

Known examples of connectors of this type include a connector disclosed in Patent Document 1. Patent Document 1 discloses several embodiments, such as a shielding plate having grounding strips that provide partial shielding for terminals and, at the same time, are in contact with resilient ground terminals or, alternatively, one formed as a grounding bar having grounding strips that have practically no shield area and are only in contact with multiple ground terminals.

In the shielding plate, the grounding strips, which extend from the front edge of said shielding plate positioned near the distal ends of the ground terminals, are rearwardly curved and their rear ends are brought into contact with the ground terminals. Alternatively, the grounding strips are formed between two grooves cut from the rear edge of the shielding plate and, by orienting them towards the ground terminals, the rear ends of said grounding strips are brought into contact with the ground terminals. In addition, in the grounding bar, the grounding strips extending rearwardly from the rear edge of said grounding bar are oriented toward the ground terminals and the rear ends of said grounding strips are in contact with the ground terminals.

At the front edge of the above-mentioned shielding plate, the rearwardly curved grounding strips are brought into contact with the ground terminals at two points. However, the grounding strips formed by making cutouts, as well as the grounding strips of the grounding bar, are in contact with the ground terminals only at one point of their rear end portions.

PRIOR ART DOCUMENTS

Patent Document

[Patent Document 1] U.S. Pat. No. 8,764,464.

SUMMARY

Problems to be Solved by the Invention

To improve grounding characteristics, it is desirable for the ground terminals and grounding strips to be in contact at positions near the points of contact of said ground terminals and counterpart ground terminals. However, in all the embodiments of Patent Document 1, the grounding strips extend rearwardly and are brought into contact with the ground terminals at positions located away from the points of contact of the above-mentioned ground terminals and counterpart ground terminals.

In the embodiment where the grounding strips are rearwardly curved at the front edge of the shielding plate, said grounding strips are in contact with the ground terminals at two points, namely, a front and a rear point, with the front point being at the position of the ground terminal tips, near the point of contact of the ground terminals and counterpart ground terminals. However, in the grounding strips, the portions corresponding to the above-mentioned positions of the ground terminal tips are curved portions, that is, base portions that curve from the shielding plate. The grounding strips used here do not possess resilience, and when the grounding strips are brought into resilient contact with the ground terminals at the rear point of the two points of contact, contact is not necessarily maintained at the above-mentioned front point. In other words, there is a chance that, among the multiple grounding strips, there might be quite a few grounding strips that have no front-point contact with the ground terminals, which may result in insufficient reliability of front-point grounding and make it necessary to rely on rear-point grounding. Such a situation is not very different from having a single rear-point contact.

In addition, in the grounding strips of Patent Document 1, when there is single rear-point contact with the ground terminals, its position is in the middle portion of the ground terminals where the amount of resilient displacement of the ground terminals is smaller in comparison with the distal ends, which correspondingly reduces the dependability of contact with the ground terminals.

Taking these circumstances into consideration, it is an object of the present invention to provide an electrical connector with a shielding plate that improves grounding characteristics by bringing the locations of contact between the grounding strips and the ground terminals closer to the points of contact of the ground terminals and the counterpart ground terminals and, in addition, improves contact reliability by placing the above-mentioned locations of contact at positions where the ground terminals have a sufficient amount of resilient displacement.

Means for Solving the Problems

In the inventive electrical connector with a shielding plate, ground terminals and signal terminals supported by insulating members are arranged in an intermixed order, the signal terminals have at least a portion in the longitudinal direction thereof covered by a shielding plate, and respective contact portions formed in the free end portions, that is, the front end side of the above-mentioned signal terminals and ground terminals, are subject to contact pressure from the corresponding counterpart terminals on one side of said contact portions, which causes them to undergo resilient flexure.

The present invention is characterized by the fact that in this electrical connector with a shielding plate, in the shielding plate, at positions corresponding to ground terminals in the direction of terminal array, there are provided grounding strips parallel to said ground terminals, said grounding strips extend forward and, at least in a state of contact between the ground terminals and the counterpart terminals, the other side of the ground terminals is in contact with and supported by the above-mentioned grounding strips.

In the present invention, the grounding strips of the shielding plate extend forward and can come into contact with the ground terminals on the side of said free end portions. Consequently, grounding characteristics are improved because the grounding strips come into contact with the ground terminals at positions near the points of contact of the above-mentioned ground terminals and counterpart ground terminals in the longitudinal direction. In addition, the free end portions of said ground terminals are portions that undergo resilient displacement at a considerable level of resilient displacement when two connectors are connected. Accordingly, in a state wherein two connectors are connected, the grounding strips come into contact with the ground terminals under high contact pressure, which improves contact reliability.

In the present invention, when the ground terminals are in a free state, the grounding strips of the shielding plate may be out of contact with said ground terminals. In such a configuration, the grounding strips come into contact with the ground terminals only if the ground terminals are resiliently displaced when the connector is mated. Therefore, the grounding strips are not in contact with the ground terminals and are not subjected to stress when the connector is not in use.

In the present invention, the grounding strips may be formed between two parallel cutout grooves rearwardly extending from the front edge of the shielding plate. The thus formed grounding strips are shaped in a so-called cut out-and-raised configuration and, in contradistinction to cases where the grounding strips are obtained by bending narrow strip-like portions projecting from the edge portion of a shielding plate, have no curved portions. Accordingly, the shielding plate can be brought into close proximity to the terminals, thereby improving shielding characteristics. Furthermore, in comparison with cases where the above-described grounding strips are formed by bending, there is no need to form the above-mentioned strip-like portions, which accordingly improves material yield.

In the present invention, the shielding plate may have rearward abutment portions abutting the ground terminals at the position of the base portions of the grounding strips or at their rearward positions. As a result of providing the shielding plate with the rearward abutment portions in this manner, the rearward abutment portions contribute to bringing said shielding plate into contact with the ground terminals, thereby increasing the number of points of contact with the ground terminals, enhancing the grounding effect and, at the same time, increasing the ability to support the ground terminals.

Effects of the Invention

In the present invention, as described above, grounding characteristics are improved because the grounding strips that extend out from the shielding plate are formed so as to extend forward and said grounding strips come into contact with the ground terminals at positions near the points of contact of the above-mentioned ground terminals and counterpart ground terminals in the longitudinal direction. At the same time, the grounding strips come into contact with the ground terminals at the time when said ground terminals undergo resilient displacement and do so at a sufficient level of resilient displacement, which improves contact reliability.

BRIEF DESCRIPTION OF THE DRAWINGS

FIGS. 5(A) and 5(B) illustrate a cross-sectional view taken at the position of the ground terminals of the electrical connector assembly of FIG. 1, wherein FIG. 5(A) illustrates a state prior to connector mating, and FIG. 5(B) a state subsequent to connector mating.

DETAILED DESCRIPTION

Embodiments of the present invention will now be described by referring to the accompanying drawings.

Figure 1:
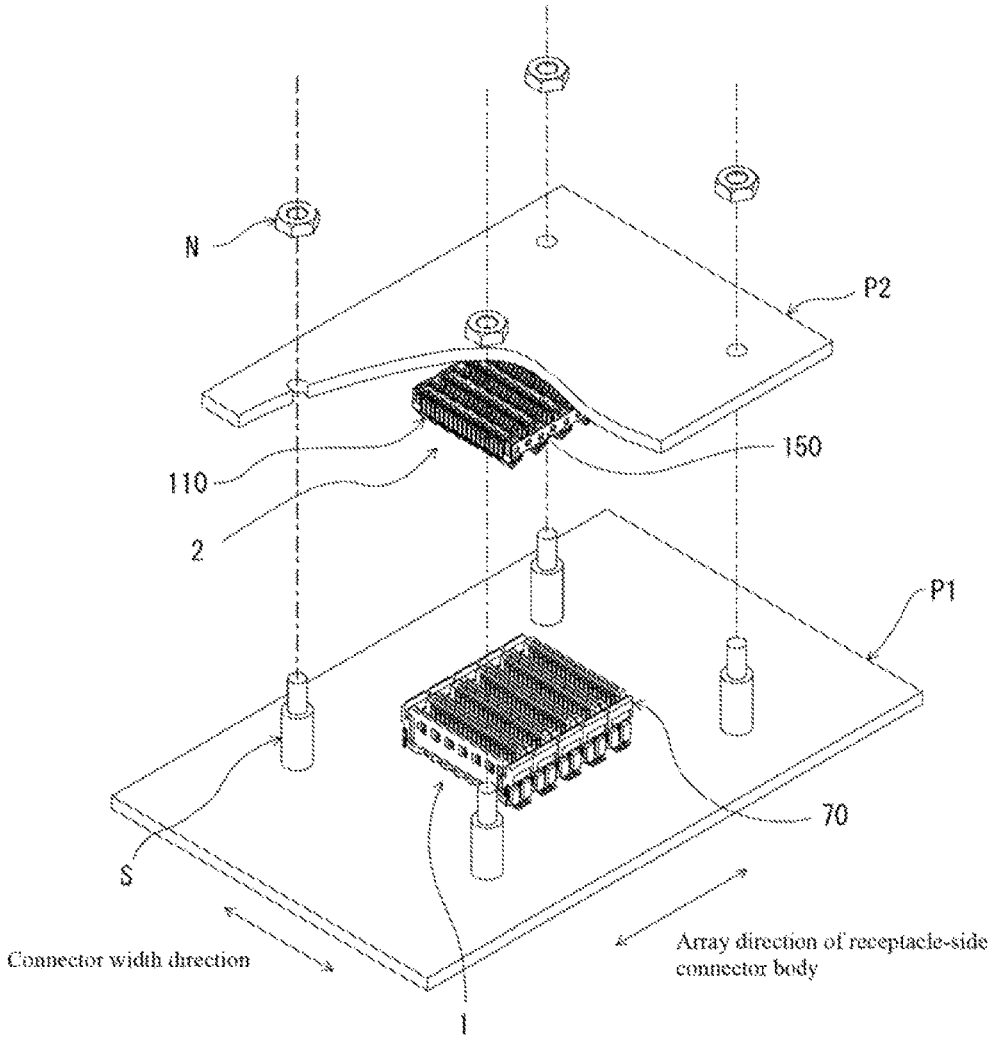
FIG. 1 illustrates an oblique view of an electrical connector assembly according to an embodiment of the present invention illustrating a state prior to connector mating.

FIG. 1 is an oblique view of an electrical connector assembly according to an embodiment of the present invention illustrating a state prior to connector mating. The connector assembly according to the present embodiment has a receptacle connector 1 and a plug connector 2 connected by mating. The receptacle connector 1 is an electrical connector for circuit boards disposed on a mounting surface of a circuit board P1 and, in addition, the plug connector 2 is an electrical connector for circuit boards disposed on a mounting surface of another circuit board P2. The two connectors 1, 2 are inserted and extracted in a direction perpendicular to the mounting surface of the circuit boards (vertically in FIG. 1).

As far as the direction of connector mating is concerned, a direction oriented to permit mating with the counterpart connector of each respective connector is designated as the forward direction. The mating direction of the receptacle connector 1 and the mating direction of the plug connector 2 are mutually opposed directions. Namely, as concerns the mating of the receptacle connector 1 to the plug connector 2, in FIG. 1, the upwardly facing direction is the forward mating direction and the downwardly facing direction is the rearward mating direction. On the other hand, as concerns the mating of the plug connector 2 to the receptacle connector 1, in FIG. 1, the downwardly facing direction is the forward mating direction, and the upwardly facing direction is the rearward mating direction.

In this embodiment, the direction of mating of the plug connector 2 to the receptacle connector 1, that is, the direction of downward movement of the plug connector 2 in FIG. 1 is referred to as the "connector mating direction," while the opposite direction, namely, the upwardly facing direction of FIG. 1, is referred to as the "connector extraction direction."

In addition, the distance between the two circuit boards P1, P2 mated to one another by the connectors is determined by multiple spacers S positioned around the connectors 1, 2 between the two circuit boards P1, P2. Said spacers S, which are shaped as cylinders extending in the vertical direction, with threads formed on both end portions thereof, are fixedly mounted to the circuit boards P1, P2 by attaching nuts N to their end portions passed through openings in the circuit boards P1, P2.

Configuration of Receptacle Connector 1

Figure 2:
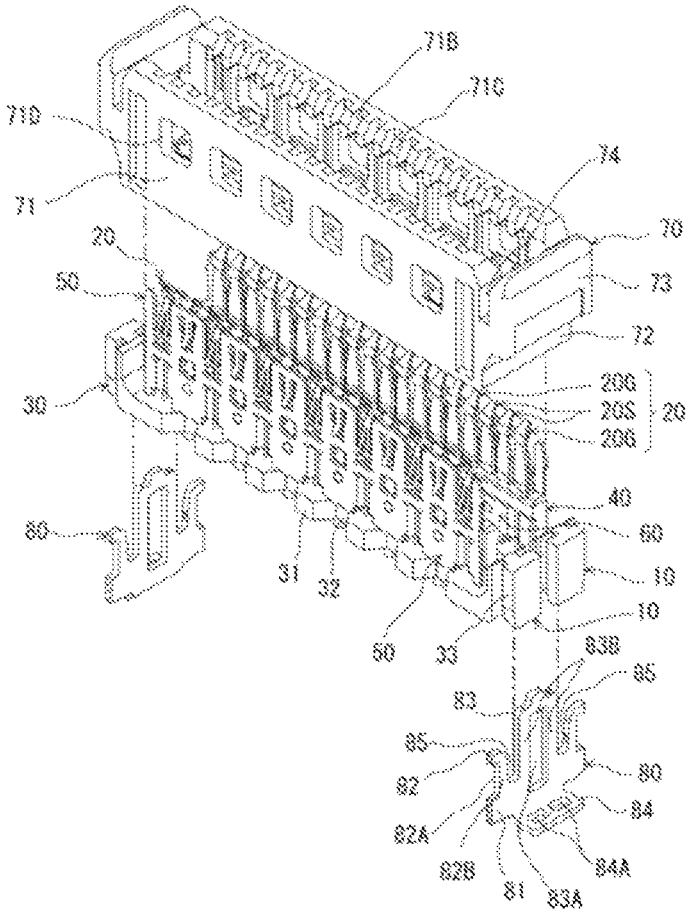
FIG. 2 illustrates a partial oblique view of the receptacle connector of FIG. 1 illustrating a state in which the casing and receptacle-side coupling members have been separated.

As can be seen in FIG. 1, the receptacle connector 1 according to the present embodiment is provided with multiple receptacle-side connector bodies 10, which form a rectangular parallelepiped-like external configuration extending such that its longitudinal direction is a direction parallel to the mounting surface of the circuit board P1, and which are arranged such that said longitudinal direction is the array direction (see FIG. 2, two receptacle-side connector bodies 10 are shown in FIG. 2); multiple casings 70, each containing a set of two adjacent receptacle-side connector bodies 10 (FIG. 2 shows a single casing 70 with two receptacle-side connector bodies 10); and two receptacle-side coupling members 80 (see FIG. 2), which extend across the array range of the above-mentioned multiple receptacle-side connector bodies 10 in the above-mentioned array direction, and which couple to, and secure in place, said multiple receptacle-side connector bodies 10 in the above-mentioned array direction on both ends of said receptacle-side connector bodies 10. Said receptacle connector 1 is designed to allow the mating portion of a plug-side connector body 110 provided in the plug connector 2 (hereinafter referred to as "mating wall portion 122" (see FIGS. 5(A) and 5(B)) to be received in the space between two receptacle-side connector bodies 10 (hereinafter referred to as "receiving portion 76" (see FIGS. 5(A) and 5(B)) contained in the above-mentioned casing 70.

Figure 3A:
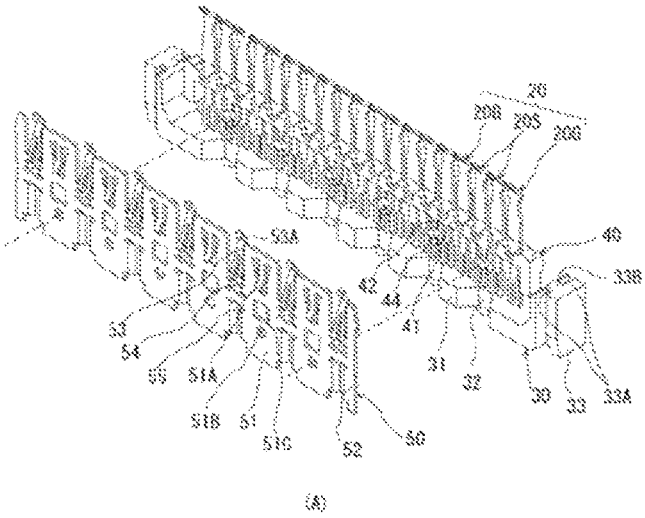
FIG. 3(A) illustrates an oblique view illustrating a receptacle-side connector body, with the shielding plate separated.
Figure 3B:
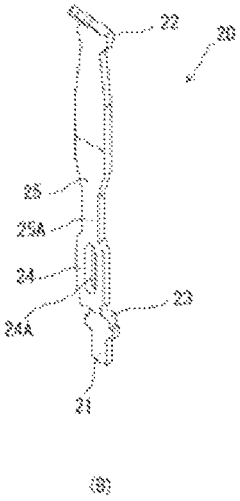
FIG. 3(B) illustrates an oblique view of a receptacle terminal secured in place by the receptacle-side connector body of FIG. 3(A).

FIG. 2, which is a partial oblique view of the receptacle connector 1 of FIG. 1, illustrates a state in which the casing 70 and receptacle-side coupling members 80 have been separated. In addition, FIG. 3(A) is an oblique view that illustrates the closer receptacle-side connector body 10 of the two receptacle-side connector bodies 10 shown in FIG. 2 in a state in which a long shielding plate 50, to be described below, has been separated therefrom, and FIG. 3(B) is an oblique view of a receptacle terminal 20 secured in place by the receptacle-side connector body 10 of FIG. 3 (A). As is best seen in FIG. 2 and FIG. 3(A), the receptacle-side connector body 10 has multiple receptacle terminals 20 arranged in the connector width direction, that is, the transverse direction of the receptacle connector 1; two terminal retainers (stationary retainer 30 and movable retainer 40, to be described below) that secure said multiple receptacle terminals 20 in place in array form using unitary co-molding; and two shielding plates (long shielding plate 50 and short shielding plate 60, to be described below) disposed in a mutually opposed relationship at positions sandwiching the receptacle terminals 20 in the array direction of the receptacle-side connector bodies 10. As can be seen in FIG. 2, in this embodiment, two receptacle-side connector bodies 10 contained in a single casing 70 are disposed facing one another in a symmetrical configuration. Below, if necessary, the sides of the two receptacle-side connector bodies 10 facing one another in the above-mentioned array direction will be referred to as "internal sides," and the opposite sides will be referred to as "external sides."

Figure 4:
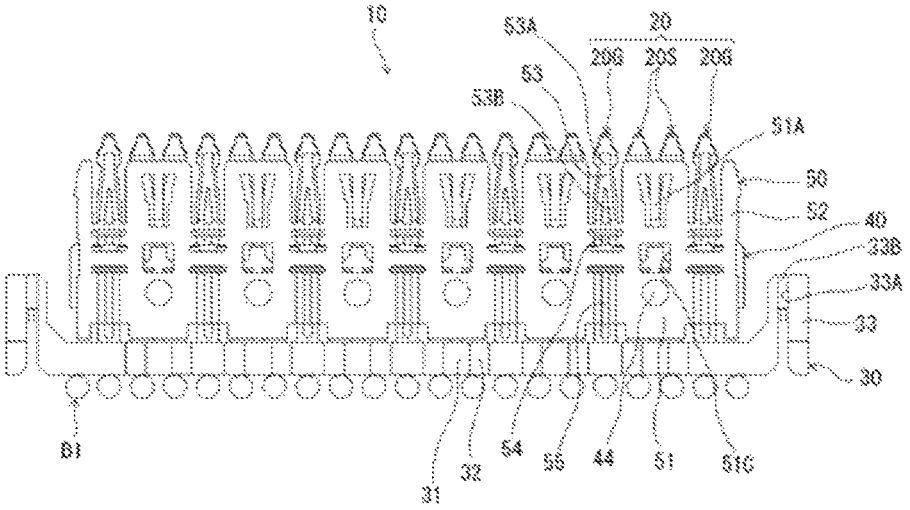
FIG. 4 illustrates a front view showing a receptacle-side connector body viewed from the direction of the shielding plate.
Figure 5A:
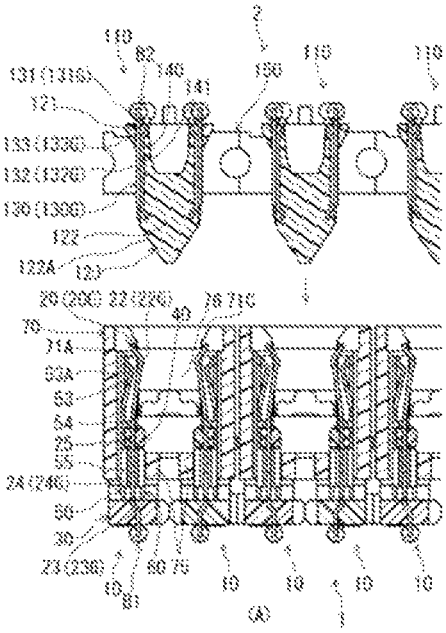
Figure 5B:
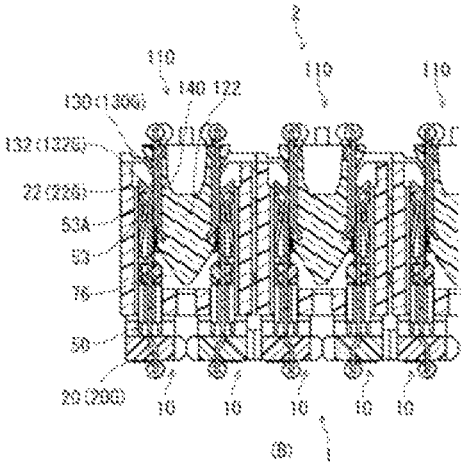

As is best seen in FIG. 3(B), the receptacle terminal 20 is fabricated by partially bending a vertically extending metal strip-like piece in the through-thickness direction. Said receptacle terminal 20 has a connecting portion 21 that is solder-connected to the circuitry portion of the mounting surface of the circuit board P1 in its lower end portion and a contact portion 22 intended for contact with a hereinafter-described plug terminal 130 provided in the plug connector 2 in its upper end portion. FIG. 4 and FIGS. 5(A) and 5(B) illustrate a state in which solder balls B1 are attached for solder-connecting the connecting portions 21. In addition, the receptacle terminal 20, in its lower half portion, has a lower retained portion 23, which is above the connecting portion 21 and adjacent to said connecting portion 21; a deformable portion 24, which is above said lower retained portion 23 and adjacent to said lower retained portion 23; and an upper retained portion 25, which is above said deformable portion 24 and adjacent to said deformable portion 24.

As can be seen in FIG. 3(A), in this embodiment, some of the multiple receptacle terminals 20 secured in place in array form by the receptacle-side connector bodies 10 are used as signal terminals 20S while others are used as ground terminals 20G. Said signal terminals 20S and said ground terminals 20G are arranged in a predetermined order. In this embodiment, the arrangement is such that ground terminals 20G are positioned respectively on both sides of two adjacent signal terminals 20S and mutually paired high-speed differential signals are transmitted to the above-mentioned two signal terminals 20S. Below, whenever the receptacle terminals 20 need to be described by distinguishing between the signal terminals 20S and ground terminals 20G, an "S" will be attached to the reference numerals of each part of the signal terminals 20S and a "G" will be attached to the reference numerals of each part of the ground terminals 20G.

As is best seen in FIG. 3(B), the contact portion 22, which is formed by bending the upper end portion of the receptacle terminal 20 in the through-thickness direction and possesses resilience in said through-thickness direction, comes into contact with the plug terminal 130 under contact pressure at its convex-curved major surface. The lower retained portion 23, which is formed in the bottom portion of the receptacle terminal 20, is a portion secured in place by a hereinafter-described stationary retainer 30 serving as a terminal retainer and is fabricated by bending in the above-mentioned through-thickness direction to produce a substantially crank-like configuration. As can be seen in FIG. 3(B), the deformable portion 24, which is located above the lower retained portion 23, is formed to have larger width dimensions than the lower retained portion 23 and a hereinafter-described upper retained portion 25 and has an opening 24A formed in the through-thickness direction through the central zone of the receptacle terminal 20 in the width direction. As a result of forming the opening 24A in this manner, the deformable portion 24 increases the width of the terminal to ensure excellent impedance characteristics and, at the same time, becomes more readily deformable in the above-mentioned through-thickness direction than other portions in the receptacle terminal 20. The upper retained portion 25, which is positioned above the deformable portion 24, is a portion secured in place by a hereinafter-described movable retainer 40 serving as a terminal retainer, and, as can be seen in FIG. 3(B), its lower half portion is formed as a narrow portion 25A that is narrower than other portions in the receptacle terminal 20.

As previously discussed, the connector assembly according to the present embodiment is used for the transmission of high-speed signals and, therefore, it is highly desired that the so-called impedance matching be ensured to minimize changes in impedance across the range of the longitudinal direction of the receptacle terminal 20. In this embodiment, the lower retained portion 23 is secured in place by the stationary retainer 30 and the upper retained portion 25 by the movable retainer 40, using unitary co-molding, and have at least a portion of their peripheral surface covered. On the other hand, since the deformable portion 24 needs to be deformed in its through-thickness direction, it is not secured in place by a terminal retainer and its entire peripheral surface is exposed to the atmosphere. Accordingly, its impedance tends to increase more than that of the lower retained portion 23 and upper retained portion 25.

In this embodiment, impedance is reduced by making said deformable portion 24 wider than the lower retained portion 23 and upper retained portion 25, thereby ensuring impedance matching between said lower retained portion 23 and upper retained portion 25. Additionally, as a result of forming the opening 24A within the width of the above-mentioned deformable portion 24, impedance matching is ensured by keeping said deformable portion 24 wider while, at the same time, said deformable portion 24 is made readily deformable in the through-thickness direction. In this manner, both impedance matching properties and easy deformation of the deformable portion 24 can be ensured in the receptacle terminal 20. Consequently, the receptacle connector 1 according to the present embodiment can be used for transmitting high-speed signals.

As can be seen in FIG. 2 and FIG. 3(A), the terminal retainers include a stationary retainer 30, which collectively secures in place the lower retained portions 23 of the all the receptacle terminals 20 provided in a single receptacle-side connector body 10 using unitary co-molding; and a movable retainer 40, which collectively secures in place the upper retained portions 25 of the all of the above-mentioned receptacle terminals 20 using unitary co-molding and is capable of producing relative angular displacement with regard to the stationary retainer 30, using an axial line extending in the connector width direction (terminal width direction) perpendicular to the above-mentioned array direction as the axis of rotation.

The stationary retainer 30, which is made of resin or another electrically insulating material, has a retaining portion 31, which extends in the connector width direction, that is, in the array direction of the receptacle terminals 20, and secures the lower retained portions 23 of the receptacle terminals 20 in place using unitary co-molding, and retained walls 33, which extend in the vertical direction and are coupled to both end portions of the retaining portion 31 in the connector width direction. In the above-mentioned retaining portion 31, both lateral faces of said retaining portion 31 are recessed to form recess portions 32 at multiple positions in the connector width direction, more specifically, at positions corresponding to two adjacent signal terminals 20S.

As previously discussed, in this embodiment, adjacent receptacle-side connector bodies 10 are disposed facing one another in a symmetrical configuration and, therefore, as can be seen in FIG. 2, the two receptacle-side connector bodies 10 adjacent to one another in the array direction of the above-mentioned receptacle-side connector bodies 10 face one another with their lateral faces on one side or their lateral faces on the other side opposing. The abutment of these mutually opposed lateral faces in the above-mentioned array direction outside the extent of the above-mentioned recess portions 32 restricts the position of the receptacle-side connector bodies 10 in said array direction.

As can be seen in FIG. 3(A), the retained walls 33 have formed therein, at positions located at both ends thereof in the connector width direction, groove portions 33A extending in the vertical direction in the form of recesses from the faces on the two sides perpendicular to the above-mentioned array direction, and, between these groove portions 33A, have formed therein retained portions 33B, which are narrower in width than other portions. Among the inner wall surfaces forming each groove portion 33A, the two opposing inner wall surfaces perpendicular to the connector width direction are facing the major surfaces of the receptacle-side coupling members 80 (see FIG. 2), as a result of which they function as restricting portions that restrict misalignment of the receptacle-side connector bodies 10 with respect to the receptacle-side coupling members 80 in the connector width direction. The retained portions 33B are secured in place by press-fitting from above into the retaining groove portions 85 (see FIG. 2) of the receptacle-side coupling members 80.

As is best seen in FIG. 3(A), the movable retainer 40, which is made of resin or another electrically insulating material, has base retaining portions 41, which extend in the connector width direction, that is, in the array direction of the receptacle terminals 20, across the entire region of the terminal array and which collectively secure in place all the receptacle terminals 20, and multiple bottom retaining portions 42, which extend downwardly from the base retaining portions 41 at positions straddling two adjacent signal terminals 20S in the connector width direction.

The bottom retaining portions 42, which are provided at positions spanning two paired signal terminals 20S, secure the side end portions (portions extending in the vertical direction) of the narrow portions 25A of said two signal terminals 20S in place and cover both major surfaces and the lateral end faces (through-thickness faces) of said side end portions. In addition, retaining studs 44 that project from both major surfaces of said bottom retaining portions 42 (surfaces perpendicular to the array direction of the receptacle-side connector bodies 10) in said array direction are provided in said bottom retaining portions 42. As discussed below, two shielding plates, namely, a long shielding plate 50 and a short shielding plate 60, are secured in place by heat-welding to said retaining studs 44.

The long shielding plate 50, which is provided facing the external major surfaces of the terminals 20, is fabricated by punching out a sheet metal member and bending it in the through-thickness direction. As can be seen in FIG. 2, FIG. 3(A), and FIG. 4, said long shielding plate 50, which has multiple long cover plate portions 51 extending such that their longitudinal direction is the vertical direction and arranged in the connector width direction and end ridge portions 52 extending in the vertical direction on both external sides of the array range of said long cover plate portions 51, is formed by coupling said long cover plate portions 51 to one another and coupling the long cover plate portions 51 to the end ridge portions 52.

In the vertical direction, the long cover plate portions 51 extend so as to span the distance between the contact portion 22 and the lower retained portion 23 of the receptacle terminal 20, and, as is best seen in FIG. 4, in the connector width direction, they extend through a range corresponding to two adjacent signal terminals 20S. As can be seen in FIG. 3(A), said long cover plate portions 51 have cantilevered mounting strips 51A with free lower ends formed in the central zone of their top halves in the connector width direction by cutting out and raising the strips. Said mounting strips 51A extend at a slant so as to be disposed progressively further away from the receptacle terminal 20 in the through-thickness direction of the long cover plate portions 51 with increasing distance in the downward direction and become more resiliently deformable in the above-mentioned through-thickness direction. As discussed below, they function as portions used for mounting to the casing 70. In addition, openings 51B intended for being secured in place by the retaining studs 44 of the movable retainer 40 are formed through said long cover plate portions 51 substantially in the central zone of their lower half portions. The long shielding plate 50 is heat-welded (collapsed by heat staking) with the retaining studs 44 of the movable retainer 40 inserted into the above-mentioned openings 51B, and as a result, is secured in place by said movable retainer 40. In addition, the long cover plate portions 51 have quadrangular windows 51C for impedance matching formed therethrough in their central zone in the vertical direction, that is, at positions between the above-mentioned mounting strips 51A and openings 51B.

As can be seen in FIG. 4, the end ridge portions 52 are positioned on both external sides of the terminal array range in the connector width direction and extend in the vertical direction across a range corresponding to the long cover plate portions 51 in the vertical direction.

As can be seen in FIG. 2, FIG. 3(A), and FIG. 4, coupling portions are used for coupling said long cover plate portions 51 to one another, and, in addition, for coupling said long cover plate portions 51 to the end ridge portions 52 at four positions in the vertical direction. As can be seen in FIG. 4, these coupling portions are provided at the positions of the ground terminals 20G in the connector width direction. At the positions of these coupling portions in the connector width direction, there are provided grounding strips 53 that extend from the topmost coupling portions upwardly along the ground terminals 20G. In other words, the grounding strips 53 are provided between two parallel cutout grooves that extend downwardly from the top edge of the long shielding plate 50 (front edge of the receptacle connector 1 in the direction of mating) in a so-called cut out-and-raised configuration. In this manner, in this embodiment, the grounding strips 53 are shaped to have a cut out-and-raised configuration. As a result, there is no curved portion in comparison with cases where the grounding strips are obtained by bending thin strip-like portions projecting from the edge portion of a shielding plate, and thus, the long cover plate portions 51 of the long shielding plate 50 can be brought into closer proximity to the receptacle terminal 20, thereby improving shielding characteristics. Furthermore, in comparison with cases where the above-described grounding strips are formed by bending, there is no need to form the above-mentioned strip-like portions, which accordingly improves material yield.

As can be seen in FIG. 5(A), the grounding strips 53, which extend at an angle so as to progressively approach the upper end portions (free end portions) of the ground terminals 20G with increasing distance in the upward direction, are resiliently displaceable in the through-thickness direction. Upper ground contact portions 53A contactable with the ground terminals 20G are formed by bending in the upper end portions of the grounding strips 53 so as to make them project towards the ground terminals 20G. In addition, as can be seen in FIG. 4, triangular-shaped openings 53B are formed in the central zone of the grounding strips 53. As a result, the grounding strips 53 are readily deformed in the through-thickness direction. As can be seen in FIG. 5(A), when said grounding strips 53 are in a free state, a gap is formed between them and the ground terminals 20G, and there is no more contact with said ground terminals 20G. In other words, when the connector is not used, the grounding strips 53 are not in contact with the ground terminals and are not subjected to stress.

In addition, the coupling portion located in the second position from the top of the long shielding plate 50 and the lowermost coupling portion are curved so as to project towards the ground terminals 20G in the through-thickness direction. The projecting top surfaces (flat surfaces) thereof are formed as ground contact portions serving as rearward abutment portions that come into abutting contact with the major surfaces of said ground terminals 20G. Below, when referring to the ground contact portions in the above-described two positions, the ground contact portion in the upper position is called "intermediate ground contact portion 54," and the ground contact portion in the lower position is called "lower ground contact portion 55." Specifically, the intermediate ground contact portion 54 is provided so as to correspond to a position directly above the upper retained portion 25G of the ground terminal 20G. In addition, the lower ground contact portion 55 is provided so as to correspond to the range of the narrow portion 25A and the top half portion of the deformable portion 24G of the ground terminal 20G in the vertical direction.

In this embodiment, the ground contact portions 54, 55, which serve as rearward abutment portions, are provided below the grounding strips 53 (behind the receptacle connector 1 in its mating direction). However, alternatively, in addition to or instead of said ground contact portions 54, 55, rearward abutment portions may be formed on the base portions of the grounding strips 53 instead of the ground contact portions 54, 55. In such a case, the rearward abutment portions can be provided, for example, by bending the base portions of the grounding strips 53 so as to make them project towards the ground terminals 20G.

Thus, the long shielding plate 50 according to the present embodiment has provided therein not only the upper ground contact portions 53A of the grounding strips 53, but also the intermediate ground contact portions 54 and the lower ground contact portions 55, which are provided at positions below the grounding strips 53, in other words, at rearward positions in the direction of mating of connector 1 with the plug connector 2. Therefore, the long shielding plate 50 comes into contact with the ground terminals 20G through the medium of the intermediate ground contact portions 54 and the lower ground contact portions 55, which increases the number of points of contact with the ground terminals 20G and accordingly enhances the grounding effect while, at the same time, increasing the ability to support the ground terminals 20G.

In the same manner as the long shielding plate 50, the short shielding plate 60, which is provided facing the internal major surfaces of the terminals 20, is fabricated by punching out a sheet metal member and bending it in the through-thickness direction. As can be seen in FIG. 2, said short shielding plate 60 is shaped by omitting the portion located above the lower ground contact portion 55 of the previously described long shielding plate 50. Specifically, said short shielding plate 60 has short cover plate portions positioned corresponding to two adjacent signal terminals 20S, end ridge portions disposed on both external sides of the terminal array range, and ground contact portions positioned corresponding to the ground terminals 20G. The ground contact portions are used for coupling the short cover plate portions to one another and, in addition, for coupling the short cover plate portions and the end ridge portions.

The casing 70 is made of resin or another electrically insulating material. As can be seen in FIG. 2, it has a substantially rectangular parallelepiped-like external configuration in which the connector width direction is the longitudinal direction. Said casing 70 has two lateral walls 71 extending in the connector width direction, two end walls 72 extending in the array direction of the receptacle-side connector bodies 10 and coupled to the end portions of the lateral walls 71, and restricted wall portions 73 positioned adjacent said end walls 72 at external side positions of said end walls 72 in the connector width direction and coupled to the external surface of said end walls 72.

In addition, the casing 70 has intermediate walls 75 that extend in the connector width direction between the two mutually opposed end walls 72 at a central position in the above-mentioned array direction, and that couple the bottom portions of said end walls 72 (see FIG. 5 (A)).

Receiving recessed portions 71A (see FIG. 5(A)), which are intended for housing the receptacle-side connector bodies 10, are formed in the internal lateral surfaces of the lateral walls 71. As can be seen in FIG. 2, arrays of multiple groove portions 71B intended for receiving the upper end portions of the receptacle terminals 20 are formed in the top portions of said lateral walls 71. In addition, guide faces 71C, which are inclined so as to be disposed progressively further away from each other in the direction of mutual opposition between the two lateral walls 71 (in the array direction of the receptacle-side connector bodies 10) with increasing distance in the upward direction, are formed in the upper edge portions of the internal lateral surfaces of the lateral walls 71. As discussed below, in the process of connector mating, said guide faces 71C guide the mating portions of the plug connector 2 (hereinafter-described mating wall portions 122) in the above-mentioned array direction towards the hereinafter-described receiving portions 76.

In addition, as can be seen in FIG. 2, mounting hole portions 71D, which are intended for receiving the mounting strips 51A of the long cover plate portions 51 of the long shielding plate 50 and engaging with said mounting strips 51A, are formed through the lateral walls 71 in the wall thickness direction of said lateral walls 71 at positions corresponding to said mounting strips 51A. The lower edge portion among the edge portions forming said mounting hole portions 71D engages with the lower end portion of the above-mentioned mounting strips 51A (the free end portion) in a lance-like configuration, thereby preventing the receptacle-side connector body 10 from being extracted from the casing 70.

As can be seen in FIG. 2, the bottom portions of the restricted wall portions 73 are coupled to the external surface of the end walls 72. When the connector is in a mated state, slits 74, which are formed between the restricted wall portions 73 and the end walls 72 such that they are open upwardly as well as in the array direction of the receptacle-side connector bodies 10, receive the hereinafter-described plug-side coupling members 150 of the plug connector 2.

As shown in FIG. 2, which illustrates a portion oriented in the above-mentioned array direction, the receptacle-side coupling members 80, which are fabricated by punching out sheet metal members extending in the above-mentioned array direction and bending them in the through-thickness direction, are disposed at positions located at both ends of the receptacle-side connector bodies 10 in the connector width direction while being oriented such that their major surfaces are perpendicular to the connector width direction. Said receptacle-side coupling members 80 extend across the entire array region of the receptacle-side connector bodies 10 in the above-mentioned array direction and are coupled to all the receptacle-side connector bodies 10, thereby securing them in place.

The receptacle-side coupling members 80 have a linear base portion 81 that linearly extends across the entire array region of the receptacle-side connector bodies 10 in the above-mentioned array direction; short plate portions 82 and a long plate portion 83 that rise up upwardly from the upper edge of said linear base portion 81 and are disposed in an alternating manner at predetermined intervals in the above-mentioned array direction; and a solder-secured portion 84 formed by bending so as to make it extend outwardly in the connector width direction from the lower edge of the linear base portion 81 at the same position as the long plate portion 83 in the above-mentioned array direction. Only part of the short plate portion 82 is shown in FIG. 2.

The short plate portions 82, which are provided at positions corresponding to gaps between two adjacent casings 70 in the above-mentioned array direction, extend in the vertical direction with substantially the same height dimensions as the retained wall 33 of the stationary retainer 30. In said short plate portions 82, there are formed a vertically extending opening 82A formed therethrough in the through-thickness direction and short arm portions 82B located on both sides of said opening 82A.

In addition, the long plate portions 83 are provided at positions corresponding to the casings 70 in the above-mentioned array direction. As can be seen in FIG. 2, they are formed to be taller than the short plate portions 82 in the vertical direction. In said long plate portions 83, there are formed a vertically extending opening 83A formed therethrough in the through-thickness direction and long arm portions 83B located on both sides of said opening 83A.

The solder-secured portion 84 is disposed on the corresponding portion of the mounting surface of the circuit board and secured to said corresponding portion with solder connections. As is best seen in FIG. 2, said solder-secured portion 84 has two fastener openings 84A formed therethrough in the vertical direction alongside each other in the above-mentioned array direction. When the solder connections are made, melted solder flows into said fastener openings 84A, thereby increasing the strength of adhesion to the above-mentioned corresponding portion.

As can be seen in FIG. 2, upwardly open groove portions extending in the vertical direction between the adjacent short plate portions 82 and the long plate portion 83 are formed as retaining groove portions 85 intended for receiving the retained portions 33B of the stationary retainers 30 of the receptacle-side connector bodies 10 from above and securing them in place by press-fitting.

Assembly of Receptacle Connector 1

The thus configured receptacle connector 1 is assembled in the following manner.

First, the receptacle-side connector bodies 10 are manufactured. Specifically, the lower retained portions 23 of the receptacle terminals 20 arranged in the connector width direction are secured in place using unitary co-molding with the stationary retainer 30. In addition, the upper retained portions 25 of the receptacle terminals 20 are secured in place using unitary co-molding with the movable retainer 40. Any of these unitary co-molding steps may be carried out first. In addition, they may be performed simultaneously. Next, after inserting the retaining studs 44 provided on one side (external side) of the movable retainer 40 into the openings 51B of the long shielding plate 50, the retaining studs 44 are heated and the protruding end portions of said retaining studs 44 are crushed, thereby expanding their diameter. As a result, said retaining studs 44 are heat-welded to the long shielding plate 50. In addition, after inserting the retaining studs 44 provided on the other side (internal side) of the movable retainer 40 into the openings of the short shielding plate 60, the retaining studs 44 are heat-welded to the short shielding plate 60 in the same manner as in the case of the above-mentioned long shielding plate 50. As a result, the shielding plates 50, 60 are secured in place by the movable retainer 40, thereby completing the receptacle-side connector body 10. In this embodiment, the step of securing the long shielding plate 50 in place and the step of securing the short shielding plate 60 in place are performed simultaneously. However, alternatively, either of the steps may be performed first.

Next, the connector is oriented such that the casing 70 is flipped over (oriented such that the guide faces 71C are positioned on the lower side) and the receptacle-side connector bodies 10 are pre-inserted into each of the two receiving recessed portions 71A of said casing 70 from above (from the side opposite to the guide faces 71C). At such time, the pair of receptacle-side connector bodies 10 that are pre-inserted into the casing 70 are pre-inserted in such an orientation that the convex curved surfaces of the contact portions 22 of the receptacle terminals 20 are in a mutually opposed relationship. The pre-inserted receptacle-side connector bodies 10 remain in a state in which a small portion thereof is housed in the receiving recessed portions 71A.

Next, the receptacle-side coupling members 80 are brought to the receptacle-side connector bodies 10 from above and the retained portions 33B of the stationary retainers 30 of the receptacle-side connector bodies 10 are provisionally secured in place using the retaining groove portions 85 of said receptacle-side coupling members 80. In the provisionally secured state, the retained portions 33B have not yet been press-fitted into the retaining groove portions 85, and only a small portion of the retained portions 33B has entered the retaining groove portions 85.

Subsequently, the receptacle-side connector bodies 10 and receptacle-side coupling members 80 are simultaneously pushed in from above. At such time, the mounting strips 51A of the long shielding plate 50 provided in the receptacle-side connector bodies 10 are pressed against the inner wall surfaces of the lateral walls 71 of the casing 70 and undergo resilient displacement. When the mounting hole portions 71D of said lateral walls 71 reach the positions of said mounting strips 51A, said mounting strips 51A return to a free state and enter the mounting hole portions 71D. As a result, the receptacle-side connector bodies 10 are housed in the receiving recessed portions 71A of the casing 70 (see FIG. 5(A)) and, at the same time, the distal ends (lower ends in FIG. 2) of the mounting strips 51A and the edge portions (lower edge portions in FIG. 2) of the mounting hole portions 71D become engageable, thereby preventing extraction from the casing 70.

In addition, when the receptacle-side coupling members 80 are pushed in, the retained portions 33B of the receptacle-side connector bodies 10 are press-fitted into and secured in place by the retaining groove portions 85 provided on both sides of the long plate portions 83 of the receptacle-side coupling members 80.

When the mounting of the receptacle-side connector bodies 10 and receptacle-side coupling members 80 to the casing 70 is complete, the space formed between the two receptacle-side connector bodies 10 inside said casing 70 constitutes a receiving portion 76 intended for receiving the mating portion of a connector body 110 provided in the plug connector 2 (hereinafter-described mating wall portion 122) (see FIGS. 5(A) and 5(B)). In addition, the upper end portions of the receptacle terminals 20 are housed in the groove portions 71B of the casing 70. In this manner, the receptacle-side connector bodies 10 and receptacle-side coupling members 80 are mounted to the casing 70, thereby completing the assembly of the receptacle connector 1.

Configuration of Plug Connector 2

The configuration of the plug connector 2 will be described next. As can be seen in FIG. 1, it is provided with multiple plug-side connector bodies 110, which are arranged in a direction parallel to the mounting surface of the circuit board P2 as the array direction, and two plug-side coupling members 150, which extend across the array range of the above-mentioned multiple plug-side connector bodies 110 in the above-mentioned array direction and secure said multiple connector bodies 110 in place by coupling thereto.

As can be seen in FIG. 1, the plug-side connector bodies 110 extend longitudinally in the connector width direction (the same direction as the connector width direction of the receptacle connector 1) and, as can be seen in FIGS. 5(A) and 5(B), have a housing 120 serving as a terminal retainer made of an electrically insulating material, multiple plug terminals 130 secured in place in array form in the connector width direction by said housing 120, and two grounding plates 140 secured in place by the housing 120.

The housing 120, which longitudinally extends in the connector width direction, is formed to have substantially the same dimensions as the receptacle connector 1 in the same direction. The housing 120 has a base portion 121, which constitutes the top portion in FIG. 5(A), and a mating wall portion 122, which extends downwardly from said base portion 121. Said mating wall portion 122 is formed as a mating portion fitted into the receiving portion 76 of the receptacle connector 1. As can be seen in FIG. 5 (A), the bottom portion of said mating wall portion 122 has inclined faces formed therein, inclined such that both lateral faces progressively approach each other with increasing distance in the downward direction, and, when viewed in the connector width direction, has a tapered configuration. The above-mentioned inclined faces are formed as guided faces 122A guided by the guide faces 71C of the previously described receptacle-side connector bodies 10 in the process of connector mating.

In addition, multiple terminal receiving portions extending in the vertical direction are formed in the housing 120 in an array configuration at regular intervals in the connector width direction, and the plug terminals 130 are housed and secured in place using said terminal receiving portions. Throughout the extent of the mating wall portion 122 in the vertical direction, said terminal receiving portions are formed as groove portions on both lateral faces of said mating wall portion 122 extending in the connector width direction (faces perpendicular to the array direction of the plug-side connector bodies 110), and, throughout the extent of the base portion 121 in the vertical direction, they are formed as openings that are in communication with the above-mentioned groove portions and pass through said base portion 121. In addition, the terminal receiving portions, in which hereinafter-described ground terminals 130G are housed, have aperture portions opening inwardly in the above-mentioned array direction formed in the bottom of the grooves (inner wall surface perpendicular to the above-mentioned array direction), and the contact portions 132G of the hereinafter-described ground terminals 130G are exposed through the above-mentioned aperture portions. As a result, as discussed below, the ground contact portions 141 of the grounding plates 140 can be brought into contact with the contact portions 132G of the ground terminals 130G (see FIG. 5(A)).

The plug terminals 130 are fabricated by punching out sheet metal members in the through-thickness direction, and their general shape is a strip-like shape linearly extending in the vertical direction. Said plug terminals 130, which are secured in place by press-fitting them from above as shown in FIGS. 5(A) and 5(B) into the terminal receiving portions of the housing 120 in such an orientation that their major surfaces become perpendicular to the above-mentioned array direction, are arranged in the connector width direction. The multiple plug terminals 130 are used as signal terminals (not shown) or as ground terminals 130G. In this embodiment, said signal terminals and ground terminals 130G are arranged according to the arrangement of the ground terminals 20G and signal terminals 20S provided in the receptacle connector 1. Specifically, the plug terminals 130 are arranged such that the ground terminals 130G are positioned so as to sandwich two adjacent signal terminals. Below, the configuration is described by simply using the phrase "plug terminals 130" when there is no particular need to distinguish between signal terminals and ground terminals 130G. In addition, if the description needs to distinguish between signal terminals and ground terminals 130G, a "G" is attached to the reference numeral of each part of the ground terminals 130G.

As can be seen in FIGS. 5(A) and 5(B), the plug terminals 130, which are provided on both lateral faces of the mating wall portion 122 of the housing 120, are provided in two rows symmetrical relative to said mating wall portion 122 in the direction of wall thickness of said mating wall portion 122 (array direction of the plug-side connector bodies 110). As can be seen in FIG. 5 (A, B), the plug terminals 130 have connecting portions 131 solder-connected to the circuitry portion on the mounting surface of the circuit board in their upper end portions and contact portions 132 intended for contacting the receptacle terminals 20 provided in the receptacle connector 1 in their lower end portions. The connecting portions 131 and contact portions 132 are coupled by the retained portions 133 secured in place by press-fitting in the base portion 121 of the housing 120. FIGS. 5(A) and 5(B) illustrate a state in which solder balls B2 are attached for solder-connecting the connecting portions 131. The contact portions 132, which extend in the vertical direction in the groove portions of the terminal receiving portions, have their major surfaces exposed on the lateral faces of the mating wall portion 122

The grounding plates 140 are fabricated by subjecting sheet metal members to press-working and bending. Said grounding plates 140 have major surfaces perpendicular to the array direction of the plug-side connector bodies 110 and extend across nearly the entire region of the plug-side connector bodies 110 in the connector width direction. As can be seen in FIGS. 5(A) and 5(B), the grounding plates 140 are located within the mating wall portion 122 of the housing 120, in other words, between rows of plug terminals 130. Namely, of the two major surfaces of the plug terminals 130, the grounding plates 140 are provided so as to be positioned on the side opposite to the surface of contact of the contact portions 132. In addition, as can be seen in FIG. 5 (A, B), the grounding plates 140 are located within a range corresponding to the contact portions 132 of the plug terminals 130 in the vertical direction.

As can be seen in FIGS. 5(A) and 5(B), the grounding plates 140 have ground contact portions 141, which protrude towards the ground terminals 130G and, at the same time, extend in the vertical direction, formed by press-working at the same positions as said ground terminals 130G in the array direction of the ground terminals 130. Said ground contact portions 141 use their projecting top surfaces (flat surfaces) to contact the major surfaces of the contact portions 132G of the ground terminals 130G.

As can be seen in FIGS. 5(A) and 5(B), in this embodiment, the two grounding plates 140, which are provided in a symmetrical configuration such that the ground contact portions 141 protrude towards opposite sides in the above-mentioned array direction (wall thickness direction of the mating wall portion 122), are secured in place using unitary co-molding with the housing 120. The grounding plates 140 have grounding leg portions (not shown) extending towards the circuit board and are solder-connected to corresponding grounding circuitry portions (not shown) of the circuit board using said grounding leg portions.

As can be seen in FIG. 1 and FIGS. 5(A) and 5(B), the plug-side coupling members 150, which are disposed at positions located at both ends of the plug-side connector bodies 110 in the connector width direction in an orientation such that their major surfaces are perpendicular to the connector width direction, extend across the entire array region of the plug-side connector bodies 110 in the above-mentioned array direction and secure all the plug-side connector bodies 110 in place by coupling thereto. Said plug-side connector bodies 150 are attached by press-fitting into retaining portions (not shown) provided on the end faces (faces perpendicular to the connector width direction) of the plug-side connector bodies 110.

The plug-side coupling members 150 may be electrically connected by contacting the grounding plates 140 and, as a result, can improve grounding effects. Furthermore, the plug-side coupling members 150 may be used as a shielding plate because they cover the end faces of the plug-side connector bodies 110 (the faces perpendicular to the connector width direction) with their major surfaces.

In addition, despite the fact that in this embodiment the grounding plates 140 and plug-side coupling members 150 are formed separately as different members, the grounding plates 140 and plug-side coupling members 150 may instead be fabricated integrally from the same sheet metal member.

Connector Mating Operation

The operation of mating of the receptacle connector 1 and plug connector 2 will be described next. First of all, a receptacle connector 1 is mounted onto a circuit board P1 and a plug connector 2 is mounted onto a circuit board P2. Specifically, the connecting portions 21 of the receptacle terminals 20 provided in all the receptacle-side connector bodies 10 are solder-connected to the corresponding circuitry portions of the circuit board and, at the same time, the solder-secured portions 84 of the receptacle-side coupling members 80 are solder-connected to the corresponding portions of the above-mentioned circuit board, thereby solder-mounting the receptacle connector 1 onto said circuit board. In addition, the grounding leg portions of the grounding plates 140 and the connecting portions 131 of the plug terminals 130 provided in all the plug-side connector bodies 110 are respectively solder-connected to the corresponding circuitry portions of the circuit board, thereby solder-mounting the plug connector 2 onto said circuit board.

Next, as shown in FIG. 1 and FIG. 5(A), the receptacle connector 1 is oriented such that its receiving portions 76 are opened upwardly and the plug connector 2 is oriented such that its mating wall portions 122 (mating portions) extend from the base portion 121 downwardly, and the plug connector 2 is brought to a position above said receptacle connector 1. Subsequently, the position of the mating wall portions 122 of the plug-side connector bodies 110 is respectively aligned with the receiving portions 76 of the corresponding casings 70.

Next, the plug connector 2 is moved down and the plug-side connector bodies 110 are inserted into the corresponding receptacle-side connector bodies 10 and mated therewith from above. At such time, the mating wall portions 122 of the plug-side connector bodies 110 cause the receptacle terminals 20 of each pair of receptacle-side connector bodies 10 opposed in the above-mentioned array direction to undergo resilient displacement in the direction away from each other, namely, such that the distance between the receptacle terminals 20 is widened, and enter the receiving portions 76. In addition, the plug-side coupling members 150 of the plug connector 2 enter the slits 74 of the casings (see FIG. 2).

As can be seen in FIG. 5(B), when the receptacle-side connector bodies 10 and the plug-side connector bodies 110 are mated, the contact portions 22 of the receptacle terminals 20 and the contact portions 132 of the plug terminals 130 are brought into contact with each other under contact pressure and establish electrical communication. Specifically, the contact portions 22S of the signal terminals 20S are brought into contact with the contact portions of the signal terminals of the plug connector 2 and the contact portions 22G of the ground terminals 20G are brought into contact with the contact portions 132G of the ground terminals 130G of the plug connector 2. In addition, in the process of resilient displacement, the ground terminals 20G abut the upper ground contact portions 53A of the grounding strips 53 of the long shielding plate 50 and subsequently undergo resilient displacement together with said grounding strips 53. As can be seen in FIG. 5(B), after mating the connectors, the ground terminals 20G and grounding strips 53 undergo resilient displacement and remain in contact with each other. Mating all the receptacle-side connector bodies 10 with the plug-side connector bodies 110 in this manner completes the operation of mating of the receptacle connector 1 with the plug connector 2.

Although in this embodiment, the grounding strips 53 of the long shielding plate 50 extend at an angle so as to progressively approach the upper end portions (free end portions) of the ground terminals 20G with increasing distance in the upward direction, the grounding strips do not have to extend at an angle. For example, the grounding strips may extend upwardly parallel to the ground terminals, without being inclined. Alternatively, the grounding strips may come into contact with the ground terminals only if the ground terminals undergo resilient displacement when the connector is used.

In addition, in this embodiment, the grounding strips 53 of the long shielding plate 50 are not in contact with the ground terminals 20G when the connector is not in use (i.e., when the connectors are not mated). However, the grounding strips 53 may instead be permitted to be in contact with the ground terminals 20G even when the connector is not in use.

In this embodiment, the grounding strips 53 extending out from the long shielding plate 50 are formed to extend towards the free end portions where the contact portions 22 of the ground terminals 20G are formed. Consequently, the upper ground contact portions 53A of the grounding strips 53 come into contact with said ground terminals 20G at positions near the points of contact between the ground terminals 20G and ground terminals 130G in the vertical direction, which improves grounding characteristics. At the same time, the grounding strips 53 contact the resiliently displaced ground terminals 20G at a sufficient level of resilient displacement, which improves contact reliability.

In addition, as previously discussed, in this embodiment, the receptacle terminals 20 have deformable portions 24 and are resiliently displaceable in the through-thickness direction, in other words, in the array direction of the connector bodies 10 and 110. Therefore, even if a certain shift occurs in the relative position of the receptacle connector 1 and plug connector 2 in the above-mentioned array direction immediately prior to connector mating, the resilient displacement of the above-mentioned deformable portions 24 will permit the receptacle connector 1 to "float" and follow the shift in the above-mentioned relative position. As a result, excellent engagement between the connectors 1, 2 can be ensured.

DESCRIPTION OF REFERENCE NUMERALS

1 Receptacle connector (electrical connector with a shielding plate)
2 Plug connector (counterpart connector)
20 Receptacle terminal
20S Signal terminal
20G Ground terminal
22, 22S, 22G Contact portions
50 Long shielding plate (shielding plate)
53 Grounding strip
54 Intermediate ground contact portion (rearward abutment portion)
55 Lower ground contact portion (rearward abutment portion)
130 Plug terminal (corresponding counterpart terminal)

The invention claimed is:

1. An electrical connector with a shielding plate in which signal terminals and ground terminals supported by insulating members are arranged in an intermixed order, signal terminals have at least a portion in the longitudinal direction thereof covered by the shielding plate, and respective contact portions formed in free end portions at front ends of the signal terminals and ground terminals are subject to contact pressure applied by counterpart terminals of a mating connector to one side of said contact portions, thereby resulting in resilient flexure, wherein:

in the shielding plate, at positions corresponding to the ground terminals in the direction of terminal array, there are provided grounding strips parallel to said ground terminals, said grounding strips extend forward and, at least in a state of contact between the ground terminals and counterpart terminals, the other side of the ground terminals is in contact with and supported by the grounding strips such that upon mating with the mating connector, the ground terminals and the grounding strips undergo resilient displacement and remain in contact with each other.

2. The electrical connector with a shielding plate according to claim 1, wherein the grounding strips of the shielding plate are out of contact with the ground terminals when said ground terminals are in a free state.

3. The electrical connector with a shielding plate according to claim 1, wherein the grounding strips are formed between two parallel cutout grooves extending rearwardly from the front edge of the shielding plate.

4. The electrical connector with a shielding plate according to claim 2, wherein the grounding strips are formed between two parallel cutout grooves extending rearwardly from the front edge of the shielding plate.

5. The electrical connector with a shielding plate according claim 1, wherein the shielding plate has rearward abutment portions abutting the ground terminals at the positions of the base portions of the grounding strips or at their rearward positions.

6. The electrical connector with a shielding plate according claim 2, wherein the shielding plate has rearward abutment portions abutting the ground terminals at the positions of the base portions of the grounding strips or at their rearward positions.

7. The electrical connector with a shielding plate according claim 3, wherein the shielding plate has rearward abutment portions abutting the ground terminals at the positions of the base portions of the grounding strips or at their rearward positions.

8. The electrical connector with a shielding plate according claim 4, wherein the shielding plate has rearward abutment portions abutting the ground terminals at the positions of the base portions of the grounding strips or at their rearward positions.

* * * * *